United States Patent [19]

Jürgens et al.

[11] Patent Number: 4,463,815

[45] Date of Patent: Aug. 7, 1984

[54] MECHANICAL JARRING TOOL

[75] Inventors: Rainer Jürgens, Celle-Osterloh; Dietmar Krehl, Latchendorf, both of Fed. Rep. of Germany

[73] Assignee: Christensen, Inc., Salt Lake City, Utah

[21] Appl. No.: 410,751

[22] Filed: Aug. 23, 1982

[30] Foreign Application Priority Data

Oct. 28, 1981 [DE] Fed. Rep. of Germany ..... 3142722
Oct. 28, 1981 [DE] Fed. Rep. of Germany ... 8131488[U]

[51] Int. Cl.[3] ..... E21B 4/06

[52] U.S. Cl. ..... 175/302; 175/321; 166/178; 267/125

[58] Field of Search ..... 175/302, 300, 293, 299, 175/321; 166/178; 267/154, 125, 137, 175, 177

[56] References Cited

U.S. PATENT DOCUMENTS

| | | | |
|---|---|---|---|
| 1,895,227 | 1/1933 | McCullough | 175/302 |
| 3,233,690 | 2/1966 | Lawrence | 175/299 |
| 4,036,312 | 7/1977 | DeLuish | 175/302 |
| 4,105,082 | 8/1978 | Cheek | 175/302 |

*Primary Examiner*—William F. Pate, III
*Assistant Examiner*—Mark J. Del Signore
*Attorney, Agent, or Firm*—Walter Fred

[57] ABSTRACT

Adjustable torsional type latching means (5) for triggering a mechanical well jar tool comprises torsionally actuated gear racks (20,22) including acme threads or teeth which extend axially on opposite adjacent side portions of telescopic parts (1,2). The gear rack teeth which mesh in the latched position have incline tooth faces that can be disengaged by applying a strong axial force which torsionally stresses and rotates a torsion sleeve (16) portion of one telescoping part (1) and gear rack (20) thereon away from the other part (2) and gear rack (22). Upon release of the latching device (5) the telescopic parts (1,2) of the well jar and the kinetic energy stored therein are freed for a limited longitudinal jarring movement. The torsion sleeve portion (16) has an end portion connected to the other telescopic parts by a second slot-spline-gear (15) of relative short axial length, which serves as a torque support in the latched position and becomes deengaged during a jarring stroke. The second slot-spline-gear (15) is separated and disconnected, by means of a rotatable connection (7) between the opposite end of the torsion sleeve portion (16) and the attached telescopic part (1), from the conventional primary slot spline gear (14) which, usually transmits the rotary drive torque between the telescopic parts (1,2) and thereby rotates the drill string and bit.

11 Claims, 2 Drawing Figures

MECHANICAL JARRING TOOL

TECHNICAL DISCLOSURE

The invention relates to a mechanical drill string jarring device having an adjustable torsional type latching device disengaged upon the application of sufficient axial force to release energy stored in the drill string and thereby deliver an up or down jar when the drill string becomes stuck in the bore hole.

BACKGROUND OF THE INVENTION

1. Field of Invention

The invention relates to a mechanical jarring tool for insertion in and freeing a drill string or bit stuck in a well bore and particularly to an adjustable torsionally releasable latch or trigger therefor.

2. Description of the Prior Art

The drill bit or portions of the drill string can become stuck or jammed in the formation during drilling of a bore hole. Freeing the drill string can be achieved by means of impact or jarring devices which are carefully inserted in the drill string when formations tending to jam the drill string or bit are present. The impact or jar device is a telescoping tool which can be slid apart or contracted together comprising an arbor or mandrel and a sleeve or barrel with rigid stop means e.g. an anvil and hammer engageable at the end positions of both of the parts. It also comprises a releaseable latch or trigger arrangement which can fix the arbor and sleeve in a starting or neutral position. In this position spring energy can be produced and stored in the drill string by raising or lowering the drill string by means of the traction arrangement on the drill tower. Upon the application of sufficient upward or downward axial force the latch disengages and the stored spring energy is converted into kinetic energy, whereby the arbor and sleeve of the jar device are displaced until their contact or stop surfaces bump into each other. Because of the very large mass of the drill string which is thus suddenly braked, vigorous blows or jars which can loosen stuck parts are produced. Frequently, however, a number of blows are required until the drill string is again freed. The aforementioned latch or trigger arrangement has the duty of preventing longitudinal motion of the telescoping displacable parts until a preselected releasing axial force is impressed on the drill string, and after this force is exceeded, permitting the unhindered displacement of the arbor and sleeve according to the direction of the prestressing force. Portions of the latch arrangement are thereby exposed to forces as great as the releasing force. During continuous use, well jar parts stressed in this manner are subjected to special problems in regard to wear and risk of fracture. Therefore, construction must be planned so that tensile, pressure or shear forces lie as far as possible below the critical limit. A mechanical jarring tool of similar concept disclosed in U.S. Pat. No. 4,105,082 has parts of the latch arrangement, on which the releasing force impressed on the drill string is exerted, comprising an arbor and a sleeve which are mutually torsionally prestressed. In one place the sleeve is provided with studs which project into longitudinal slits or slots of the arbor; in another place the sleeve has an oblong opening or recess, on one side of which is an axially directed row of teeth of trapezoidal shape, which mesh with similar trapezoidal gear teeth of the arbor. When axial tension or compression is mutually imposed on the arbor and sleeve, the meshing teeth gear are pushed out of contact as a result of the simultaneous relative rotation of arbor and sleeve by the resultant force created by the axial force imposed upon the inclined faces of the teeth. Because arbor and sleeve are, however, fixed against relative rotation at another place by the studs, a torsional moment is built up which counteracts the separating tendency of the gear teeth.

The magnitude of the torsional moment which is found when the gear tooth segments move apart completely and the slope of the tooth profile define the releasing force. The torsional stressing of the arbor and sleeve for producing an interlocking force, which is in a direction opposed to the force which appears in the drill string, permits the avoiding of critical tensile, pressure or shear forces in the spring element as described in the U.S. patent. This is possible because the specific deformation path is small due to the large spatial expansion of the spring element. However, there are several characteristics which are detrimental to a successful application of the principle in the construction described in U.S. Pat. No. 4,105,082.

For example, after the arresting or latching device is exercized or released, the arbor and sleeve are still under torsional stress, which results in strong frictional forces between the engaging front surfaces of the gear tooth segments and the contact surfaces of studs and longitudinal splines. Besides severe wear of parts which slide over one another, the frictional forces also consume a portion of the kinetic energy of the detensioning drill string so that the intensity of the blow exercised during impact on the striking surface is diminished. Wear on the studs directed into longitudinal slots is especially pronounced due to the small contact surface and the consequently high surface pressure. Adjustment of the releasing force is possible only in coarse steps of increments and only with the help of a special tool.

SUMMARY OF THE INVENTION

The primary object of the instant invention is to provide a mechanical jarring tool with an adjustable torsion latching device that avoids the above mentioned disadvantages of the prior art devices.

Thus, the jarring tool according to the invention has the following distinguishing features and advantages over similar known prior art jars.

The part of the latching device subjected to torsional stress is preferably in the form of a torsion sleeve disengaged from the spline or key parts which serve to transmit the rotary driving torque along the drill string, so that, on the one hand, the driving torque does not affect the torsional stress and therefore the releasing force, and, on the other hand, detensioning of the latching device in the unlocked state is possible.

A separate secondary torque support is attached to the latching device, supplementing the primary slot-key-gearing, which serves to transmit rotary driving torque between axially displacable parts and which is usually found in rotatable telescopically assembled drill tools. The secondary torque support is likewise constructed as a secondary slot-key-gearing but is shorter than the maximum travel length of arbor and sleeve with respect to its axial length. The latching device further comprises arresting or latching elements in the form of acme or trapezoidal gear strips by means of which arbor and sleeve are locked in a way well known of itself. If unlocking by an axially applied overload force and a short travel path should occur, the contact surfaces of the special secondary slot-key-gearing lose mutual contact and the torsion sleeve can return to a state of decreased tension.

Thus, neither the front surfaces of the teeth or the sides of the slot-key-gearing press together during the further and greater portion of axial displacement, so that the jarring tool can carry out telescoping displacement without obstruction and decreasing the force of impact. During this displacement phase no substantial wear occurs on the named surfaces. Re-latching of the latching device by intergliding reengagement of the special secondary slot-key-gearing of the arbor and sleeve is facilitated by means of bevels on the opposite entrance side portions of the slot-key-gearing. Adjustable means to attain the desired amount of releasing force is made possible by relatively adjustable saw-toothed control strips with inclined mating cam surfaces which permit presetting of the torsion angle and tensioning or stressing of the torsion sleeve. The non-rotational axial adjustment of one of the saw tooth camming strips with threaded end portions takes place with the aid of a threaded nut rotatable by means of a bevel gear and pinion without special tools. In an appropriate manner, the parts are preferrably housed in the same portion or the same socket section of the outer sleeve without interposition of a threaded connection. This is done to arrange the special arbor-sleeve-gear and the position of the gear strip in an unequivocal manner. Additional advantageous characteristics of the invention will become apparent from the following description and appended claims.

DESCRIPTION OF THE PREFERRED EMBODIMENT(S)

Figure 1:
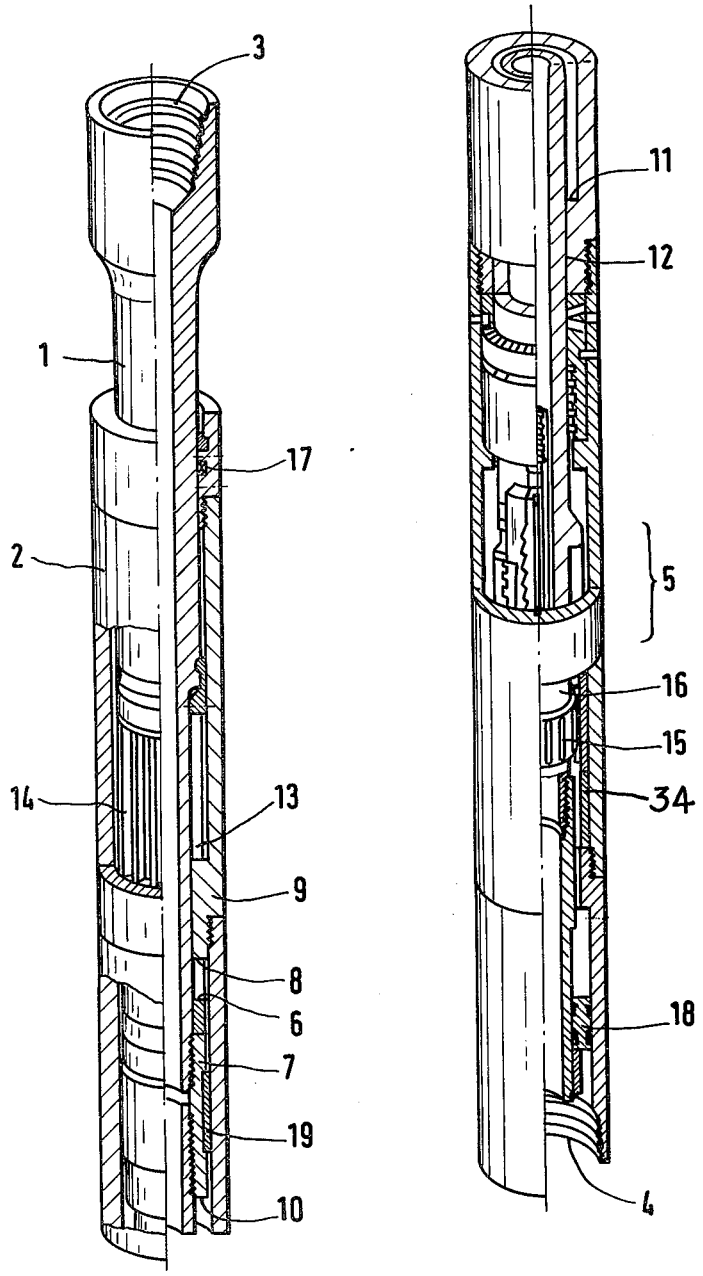
FIG. 1 is a three-dimensional view partly in section of a mechanical jarring tool with the adjustable latch means or device according to the invention.

The impact or jarring tool illustrated in FIG. 1 consists of an inner mandrel or arbor 1 and an outer barrel or sleeve 2, which are telescopically displacable. On their outer ends, the arbor and sleeve have, at times, threaded end portions or sleeves 3,4 by means of which the jarring tool can be inserted into a drill string. In the starting or latched state, i.e., when the impact tool is in a readiness setting, and during normal drilling operation the arbor 1 and sleeve 2 are latched together and maintained in a central position by a latch or trigger device 5. When the latching device 5 is released the arbor and sleeve can be slid together as well as apart, and in fact at times to engaging stops. During use of the impact tool these stops serve as striking surfaces or shoulders. When the tool is extended or pulled apart a surface or hammer 6 on a part of a connecting sleeve 7 bounces or strikes against a surface or anvil 8 on the lower end of a slot-spline-sleeve 9. When slid or contracted together, another surface serving as a hammer 10 on the lower end of the coupling or connecting sleeve 7 bounces or strikes against another surface or anvil 11 adjoining a narrow part 12 of the sleeve 2.

To transmit torque from rotatable arbor 1 to rotate sleeve 2, both parts are provided with primary intermeshing axial slot-spline-gears 13 and 14 which extend over a narrow region, whereby the internal slot-spline-gear 13 on sleeve 9 encloses the external slot-spline-gear arbor portion 14 of arbor 1.

Further on down, the arbor 1 has a lower torsionally stressable part that is isolated, with regard to torsion from the upper part or piece which carries the primary slot-spline-arbor 14, by means of a double threaded connecting sleeve or coupling 7. For this purpose one part of the double threaded connection is not locked against counter rotation relative to the arbor and is provided with a cylindrical acme thread. The latching device 5 is located in a gap or pocket between arbor 1 and sleeve 2 below the connecting sleeve 7. A separate secondary slot-spline-gear means 15 is located further down at a definite axial distance or separation from the above. The region of the arbor 1 which lies between, serves as a torsion sleeve or portion 16. Threaded connections are avoided in the sleeve 2 as well as the arbor 1 in the region of the latching device 5, torsion sleeve 16 and the separate slot-spline-gear 15 so that a fixed angle of or amount of angular rotation between the latching device 5 and the slot-spline-gear 15 is assured at any load and a reproducible relationship between releasing force and setting can be achieved.

To minimize wear of the movable parts, the slot-spline-gears 13 and 15 are located in an oil bath. The oil chamber is sealed off from the flushing chamber by means of a fixed seal 17 and an axially displacable seal 18 for pressure and volume compensation.

To improve the oil flow through the primary slot-spline-gear 13 during sliding motion between arbor 1 and sleeve 2, the connecting sleeve 7 has an outer casing 19 which serves as a pump piston and which has the same diameter as the arbor in the region of the fixed seal 17. When the tool is pulled apart or extended, oil is pushed into the space between slot-spline-gear 13 and the fixed seal 17 through the narrow slot-spline-region by means of the outer annular casing or piston 19. Excessive loading of the fixed seal 17 by an intermittent pressure difference between the oil chamber and the flushing chamber is thereby avoided. The outer piston casting 19 must have the exact amount of leakage loss to produce a steady-state pressure equalization in the whole oil chamber.

Figure 2:
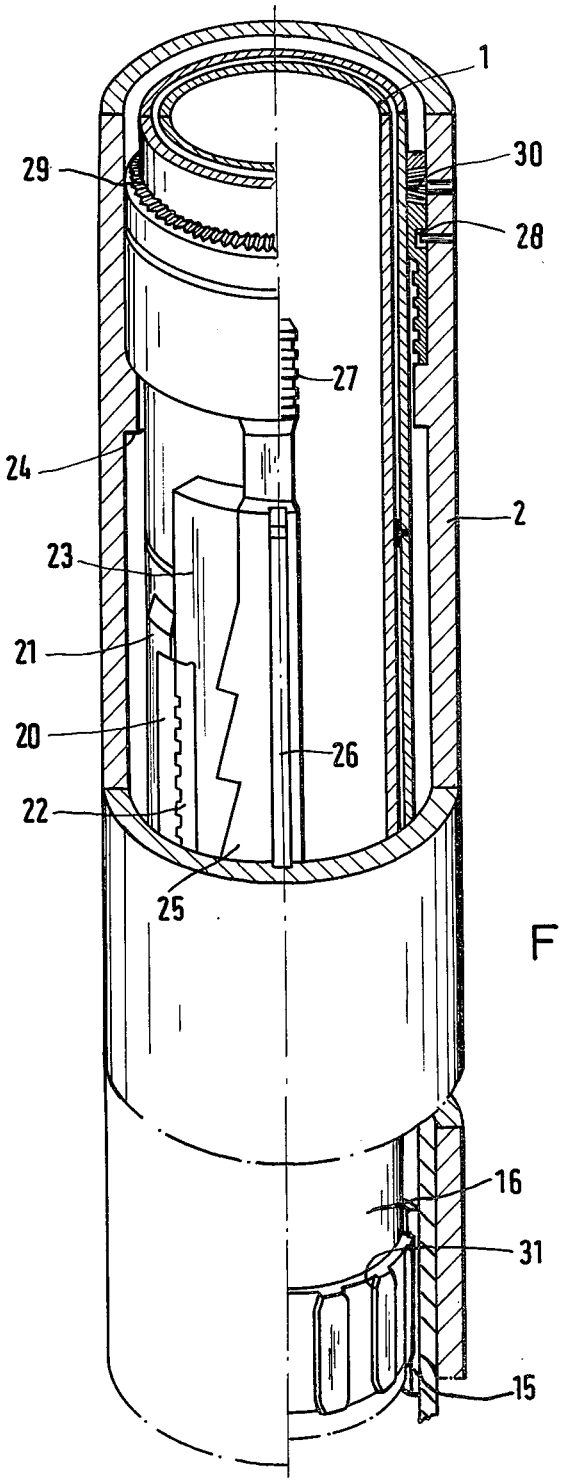
FIG. 2 is an enlarged three-dimensional view partly in section of a portion of the jarring tool and of the latching device therein.

The latching device 5 will now be explained by means of the schematic drawing in FIG. 2.

To achieve a symmetrical loading of the arbor 1, the axially arranged parts are present in pairs which face each other from diametrically opposite sides of the arbor. In FIG. 2, however, only one or half of the pair, spaced 180° apart, can be seen. A toothed arbor latch or stop strip 20 on the arbor side lies in the recess or pocket of an externally raised retaining portion or swelling 21 which projects radially from and is connected with the torsional portion 16 of arbor 1. Since only right-hand or clockwise directed rotational forces can act on the stop strip 20, it is axially and tangentially or circumferentially secured by the pocket against displacement from the arbor 1. It can, however, be pulled out for disassembly. Another toothed sleeve latch or stop strip 22 on the sleeve side also rests in a pocket of a tangentially or circumferentially movable support strip 23 and meshes with the teeth of stop strip 20 on the arbor side.

The support strip 23 is situated within and fixed axially relative to the sleeve 2 by an internal upper annular surface or shoulder 24 and the annular end surface of a lower internal sleeve 34 within outer sleeve 2 (visible in FIG. 1) and between which, strip 23 is arranged to be adjusted and move tangentially. The support strip 23 also has helical teeth with inclined cam engaging surface on its opposite side or edge away from the pocket that engage and mesh with similar teeth and inclined camming surfaces of an adjusting strip or cam 25.

The adjusting cam or strip 25 is situated within and arranged to move axially with respect to the sleeve 2 but is secured against tangential rotative movement relative thereto by a key 26 and keyway. The adjustable cam 25 has a threaded section 27 on its upper end which meshes with an axially fixed but rotatable adjusting nut 28. The rotatable adjusting nut 28 has a bevel-gear rim 29 including teeth which mesh with teeth of a bevel-gear pinion 30. This bevel-gear pinion has an end portion extending through the wall of the sleeve 2 by which it can be actuated from the outside by means of a hexagonal socket head therein and inserting a suitable tool to turn the pinion 30 and adjusting nut 28. The adjusting strip 25 is thereby displaced to a desired axial position by rotating nut 28 relative to non-rotatable threaded section 27. Due to the form of the meshing teeth on the helical geared sides of the adjusting strip 25 and the support strip 23 which slide on each other, the support strip 23 turns aside in a right hand or clockwise rotational sense when viewed from above when the adjusting strip 25 is lifted, and transmits the rotational motion and force through the stop strips 20,22 onto the arbor 1. Because the arbor 1 is further secured against rotation relative to sleeve 2 on the under or lower side by the separate slot-spline-gear 15, a right hand or clockwise rotation in the region of the stop strips produces an inner torsional moment between the section 16 of the arbor which lies between the stop strips 20,22 and the slot-spline-gear 15. This region is developed as a thin-walled torsion sleeve 16 to produce a relatively soft spring characteristic.

The axial expansion or extent of engagement between the separate slot-spline-gear 15 portion is limited to a shorter region in comparison to the maximum axial displacement path of the arbor 1 relative to the sleeve 2.

To permit reengagement of the secondary slot-spline-gear 15, the ends of the tooth or spline sides are provided with guiding entry curves or bevels 31.

To produce an up or down jar and free a stuck drill bit or string the release of the preadjusted latch or trigger device 5 is begun by either pulling up and tensioning or pushing down on and compressing the arbor 1 relative to the sleeve 2 normally attached to the stuck member. During a small amount of displacement, the inclined sides of the engaging acme threads or teeth of the gear racks or strips 20,22 slide over one another, whereupon the gear strip 20 and attached torsion sleeve 16 on the arbor side turns aside in a right hand or clockwise rotational sense against increasing torsion of the sleeve 16. The axial force which must be exerted to achieve complete separation of the rows of gear teeth is determined by the edge steepness or slope angle of the engaging inclined surfaces of the teeth, the gear tooth depth of engagement, the spring constants of the torsion strip or sleeve portion 16 and the prestressing impressed by the adjusting strip 25. When sufficient axial force is applied the gear racks or toothed latch strips 20 and 22 are completely separated, the arbor 1 is free to move axially and accelerated by the kinetic energy in the direction of the applied force until its hammer strikes against the anvil or strike shoulder of the sleeve 2. During the first relative short part of the free axial displacement of, the arbor 1 relative to the sleeve 2, side portions of the separate secondary short slot-spline-gear 15 are still engaged. On further axial displacement they become disengaged, whereupon the torsional stress imposed on torsion sleeve 16 is relieved and hence the frictional forces caused by surface pressure on the sides of the separate secondary slot-spline-gear 15 and on the front surfaces of the gear tooth strips also disappear. During reengagement to the latch position, torque is reestablished by the gradual guided engagement of the curved or beveled entrance portions 31 and sides of the secondary slot-spline-gear 15.

By means of a so-called key gearing of the stop strips 20,22, their ability to mesh together in individual places only is attained.

What is claimed is:

1. A mechanical jar adapted for insertion into and to deliver blows to a drill string when it becomes stuck in a bore hole comprising:

a sleeve including first impact means;

an arbor including second impact means longitudinally and telescopically displacable in and relative to the sleeve;

a first primary slot-spline-gear drive means on engaging intermeshing portions of the telescopic arbor and sleeve for transmitting torque between the arbor and sleeve;

releasable latch means including first and second gear segments, with intermeshing gear teeth and inclined surfaces on the intermeshing gear teeth of the gear segments extending axially on sides of the respective arbor and sleeve;

torsionaly stressable means on a portion of the arbor connected to move axially with, rotate relative to and torsionally isolated from the first slot-spline-gear drive means, for maintaining latching engagement of the intermeshing teeth until sufficient axial force has been applied to the drill string;

torque support means, between a portion of the torsionally stressable means and the sleeve, adapted to allow axial disengagement and reengagement of, support and prevent, during reengagement, rotation of the portion of the torsionally stressable means relative to the sleeve; and connecting means coupling and allowing rotative movement of the isolated torsionally stressable means on the portion of the arbor supported by the torque support means relative to the telescopic portion of the arbor and the first slot-spine-gear drive means whereby the application of sufficient axial force causes inclined engaging surfaces of the intermeshing gear teeth to impart a torsional rotative movement of a portion of the arbor and first gear segment thereon away from and slide out of engagement the second gear segment on the sleeve without imposing torsional stress and increasing frictional forces between engaging surfaces of the first slot-spline-gear drive means and thereby allow relatively free axial movement between the arbor and sleeve under the influence of kinetic energy stored in the drill string.

2. A mechanical jar according to claim 1 wherein the torque support means comprises:

a second slot-spline gear means on engaging intermeshing portions of the torsionally stressable means and the sleeve and which are adapted to disengage and release torsional stress following release of the latch means and to reengage and reset upon relatching of the latch means.

3. A mechanical jar according to claim 1 wherein the connecting means comprises:

a threaded connection unlocked by uncountered rotation of the torsionally stressable means imparted to it by the inclined surfaces of the intermeshing gear teeth during the application of the axial force.

4. A mechanical jar according to claim 1 wherein the torsionally stressable means comprises:

a torsion sleeve connected to and which forms a portion of the arbor.

5. A mechanical jar according to claim 4 further comprises:

latch adjusting means adjoining and supporting the second gear segment on the sleeve for engaging and tangentially rotating the first gear segment and attached torsion sleeve relative to the sleeve and thereby vary the axial force required to release the latching means.

6. A mechanical jar according to claim 5 wherein the latch adjusting means comprises:

tangentially movable means adjacent to and supporting the second gear segment on one side thereof, fixed axially relative to the sleeve and having at least one cam engaging surface on an opposite side thereof; and adjustable cam means including a cam with a camming surface thereon axially movable relative to the sleeve for engaging at least one cam engaging surface and tangentially displacing the tangentially movable means and the second gear segment relative to the sleeve and thereby rotate the first gear segment and torsionally adjust the torsion sleeve to release the latch means at the desired axial force.

7. A mechanical jar according to claim 6 further comprising:

cam adjusting means in and operable from outside the sleeve for moving the cam and camming surface axially relative to the sleeve and the cam engaging surface on the tangentially movable means.

8. A mechanical jar according to claim 7 wherein the cam adjusting means comprises:

an annular rotatable nut fixed against axial displacement within the sleeve and having screw threads engaging mating screw threads on the cam, and bevel gear teeth on an end of the nut; and a bevel gear pinion meshing with the gear teeth and having a portion rotatably mounted in and extending radially through a wall portion of the sleeve to an end portion adapted to receive a suitable tool for rotating the bevel gear pinion, bevel gear and nut relative to the sleeve and axially displace the cam.

9. A mechanical jar according the claim 6 further comprising:

a pair of each of the first and second gear segments, the adjacent tangentially movable means and the adjustable cam means each situated diametrically opposite the other of the pair.

10. A mechanical jar according to claim 2 wherein the second slot-spline-gear means has:

an axial length shorter than the maximum telescopic axial displacement between the first and second impact means of the arbor and sleeve, and reentry bevels on ends of and sides of the slot-spline-gear means adapted to facilitate reengagement and reestablish torsion in the torsion sleeve.

11. A mechanical jar according to claim 10 further comprising:

an oil filled chamber between the arbor and sleeve in which the first and second slot-spline-gear means and the latch means are located, seal means between the arbor and sleeve for sealing off both ends of chamber and prevent entrance of drilling fluid normally passed through the drill string, and a piston sleeve situated about the arbor and adapted for pumping the oil through narrow portions of the chamber and through the first and second slot-spline-gear means during telescopic movement between the arbor and the sleeve.

* * * * *